US009763307B2

(12) United States Patent
Aliakseyeu et al.

(10) Patent No.: US 9,763,307 B2
(45) Date of Patent: Sep. 12, 2017

(54) LIGHTING CONTROL BASED ON INTERACTION WITH TOYS IN PLAY AREA

(71) Applicant: PHILIPS LIGHTING HOLDING B.V., Eindhoven (NL)

(72) Inventors: Dzmitry Viktorovich Aliakseyeu, Eindhoven (NL); Jonathan David Mason, Waalre (NL); Sanae Chraibi, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/105,085

(22) PCT Filed: Dec. 11, 2014

(86) PCT No.: PCT/IB2014/066802
§ 371 (c)(1),
(2) Date: Jun. 16, 2016

(87) PCT Pub. No.: WO2015/092631
PCT Pub. Date: Jun. 25, 2015

(65) Prior Publication Data

US 2016/0323969 A1 Nov. 3, 2016

Related U.S. Application Data

(60) Provisional application No. 61/917,993, filed on Dec. 19, 2013.

(51) Int. Cl.
*H05B 37/02* (2006.01)
*A63H 33/42* (2006.01)
(Continued)

(52) U.S. Cl.
CPC ..... *H05B 37/0227* (2013.01); *A63F 9/001* (2013.01); *A63G 31/00* (2013.01);
(Continued)

(58) Field of Classification Search
CPC ..... H05B 37/0227; H05B 33/0854; H05B 33/0872; H05B 37/0272; A63F 9/001;
(Continued)

(56) References Cited

U.S. PATENT DOCUMENTS 6,016,038 A 1/2000 Mueller et al.
6,211,626 B1 4/2001 Lys et al.
(Continued)

FOREIGN PATENT DOCUMENTS

WO 2007069163 A1 6/2007
WO 2007141675 A1 12/2007
WO 2011073881 A1 6/2011

*Primary Examiner* — Daniel D Chang
(74) *Attorney, Agent, or Firm* — Meenakshy Chakravorty

(57) ABSTRACT

The present disclosure is directed to inventive methods, systems and apparatus for lighting control. For example, light output of a lighting system (100) that illuminates a play area (101) may be altered, e.g., by a lighting system controller (102, 302), based on characteristics of toys (104) one or more children is playing with in the area, as well as alterations of the toys or relationships between the toys that the one or more children are effecting.

20 Claims, 3 Drawing Sheets

(51) Int. Cl.

| | |
|---|---|
| ***A63F 9/00*** | (2006.01) |
| ***A63H 33/22*** | (2006.01) |
| ***A63G 31/00*** | (2006.01) |
| ***H05B 33/08*** | (2006.01) |

(52) U.S. Cl.
CPC ..... *A63H 33/22* (2013.01); *A63H 33/42* (2013.01); *H05B 33/0854* (2013.01); *H05B 33/0872* (2013.01); *H05B 37/0272* (2013.01); *A63H 2200/00* (2013.01)

(58) Field of Classification Search
CPC ..... A63F 13/12; A63G 31/00; A63H 33/22; A63H 33/42; A63H 2200/00
USPC ..... 315/158, 152, 297, 312
See application file for complete search history.

(56) References Cited

U.S. PATENT DOCUMENTS

| | | | | |
|---|---|---|---|---|
| 6,933,685 | B2 | 8/2005 | Gutta et al. | |
| 2002/0105286 | A1 | 8/2002 | Brownell | |
| 2006/0154726 | A1 | 7/2006 | Weston et al. | |
| 2012/0206050 | A1 | 8/2012 | Spero | |
| 2012/0295704 | A1* | 11/2012 | Reiche | A63F 13/06 463/31 |
| 2013/0165223 | A1* | 6/2013 | Leyland | A63F 13/02 463/30 |
| 2015/0174479 | A1* | 6/2015 | Reiche | A63F 13/12 463/31 |

* cited by examiner

LIGHTING CONTROL BASED ON INTERACTION WITH TOYS IN PLAY AREA

CROSS-REFERENCE TO PRIOR APPLICATIONS

This application is the U.S. National Phase application under 35 U.S.C. §371 of International Application No. PCT/IB2014/066802, filed on Dec. 11, 2014, which claims the benefit of U.S. Provisional Patent Application No. 61/917,993, filed on Dec. 19, 2013. These applications are hereby incorporated by reference herein.

TECHNICAL FIELD

The present invention is directed generally to lighting control. More particularly, various inventive methods, systems and apparatus disclosed herein relate to controlling lighting based on characteristics and/or alterations of one or more physical objects in an environment.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Lighting systems exist that incorporate LEDs and fixtures such as those described above. However, light output is typically controlled using various interfaces, such as a wall-mounted interface and/or a smart phone or tablet computer, Light output is not typically based on activity occurring in the environment being illuminated. There are scenarios in which light output of lighting systems is automatically controlled based on various parameters, such as time of day or placement of a product in a display. In some such instances, light output may be altered based on which product in the display a user is looking at. However, there are no lighting systems for which light output is controlled automatically by user interaction with one or more physical objects in an environment. Thus, there is a need in the art for a lighting system configured to provide light output that is automatically adjusted based on user interaction with one or more objects in an environment, for example toys in a play area, thereby providing customized ambient, accent, spot or other kind of illumination, enhancing a child's toy-playing experience.

SUMMARY

The present disclosure is directed to inventive methods, systems and apparatus for lighting control based on characteristics and/or alterations of one or more physical objects in an environment. For example, in some embodiments, one or more attributes of light output by a lighting system to illuminate a play area may be selected based on characteristics of toys one or more children is playing with in the area, as well as alterations of the toys and/or relationships between the toys.

Generally, in one aspect, a method for controlling a lighting system having one or more LEDs may include: receiving, at a lighting system controller, a signal indicative of a characteristic of one or more toys present in a play area supplied with ambient light by the lighting system; receiving, at the lighting system controller, a signal indicative of an alteration of the one or more toys; and energizing, by the lighting system controller, the one or more LEDs of the lighting system to illuminate the play area with light having one or more attributes selected based on the characteristic of the one or more toys and the alteration of the one or more toys.

In various embodiments, the method may further include determining, by the lighting system controller based on the characteristic of the one or more toys, an identity associated with the toy. In various versions, the method may further include corresponding, by the lighting system controller, with a remote computing system to determine an additional characteristic of the one or more toys based on the identity of the toy, wherein the one or more attributes of the light are selected based on the additional characteristic of the one or more toys. In various versions, the additional characteristic may include a color associated with the one or more toys. In various versions, the method may further include: facilitating, by the lighting system controller, an image search by a search engine associated with the remote computing system; and selecting, by the lighting system controller, the color based on results of the image search. In various versions, the additional characteristic comprises one or more predefined light attributes associated with the one or more toys or a combination of the one or more toys.

In various embodiments, the signal indicative of the alteration of the one or more toys may include a signal indicative of a change in proximity between two or more toys. In various embodiments, the signal indicative of the alteration of the one or more toys comprises a signal indicative of physical contact between two or more toys. In various embodiments, the signal indicative of an alteration of the one or more toys may include a signal indicative of a change in orientation of the one or more toys.

In various embodiments, the one or more toys includes a first toy, and the signal indicative of the alteration of the one or more toys includes a signal indicative of an addition of a second toy to the play area. In various versions, the signal indicative of a characteristic of one or more toys present in the play area may include a signal indicative of a characteristic shared between the first toy and the second toy. In various versions, the shared characteristic may include a color or brightness. In various versions, the shared characteristic may include an environment inhabited by fictional or nonfictional organisms or characters on which the first and second toys are based. In various versions, the one or more attributes of the light may include a color or brightness associated with the environment.

In various embodiments, the signal indicative of a characteristic of one or more toys present in the play area may include a signal from an image capture device. In various embodiments, the signal indicative of a characteristic of one or more toys present in the play area may include a wireless signal from a transmitter associated with the one or more toys.

In various embodiments, the one or more attributes of the light may be selected further based a number of lighting units configured to illuminate the play area. In various embodiments, the one or more attributes of the light may be selected further based a spatial arrangement of lighting units configured to illuminate the play area. In various embodiments, the one or more attributes of the light may be selected further based on light-rendering capabilities of lighting units configured to illuminate the play area.

In various embodiments, transitory and non-transitory computer-readable media may be configured with instructions that, in response to execution of the instructions by a lighting system controller, cause the lighting system controller to perform one or more of the aforementioned methods.

In another aspect, a lighting system may include: one or more LEDs; one or more sensors to detect a characteristic of one or more toys present in a play area illuminated by the lighting system and an alteration of the one or more toys; and a lighting system controller operably coupled with the one or more LEDs. The lighting system controller may be configured to: receive, from the one or more sensors, signals indicative of the characteristic of one or more toys present in a play area and the alteration of the one or more toys; and energize the one or more LEDs of the lighting system to illuminate the play area with light having one or more attributes selected based on the characteristic and alteration of the one or more toys.

In various embodiments, the lighting system controller is further configured to identify, based on the characteristic of the one or more toys, an identity associated with the toy. In various versions, the lighting system controller is further configured to correspond with a remote computing system to determine an additional characteristic of the one or more toys based on the identity of the toy, wherein the one or more attributes of the light are selected based on the additional characteristic of the one or more toys. In various versions, the additional characteristic may include a color or brightness associated with the one or more toys. In various versions, the lighting system controller is further configured to: facilitate an image search by a search engine associated with the remote computing system; and select the color based on results of the image search.

In another aspect, an apparatus for controlling a lighting system with one or more LEDs may include: one or more processors; and memory operably coupled with the one or more processors. The memory may contain instructions that, in response to execution of the instructions by the one or more processors, cause the one or more processors to: receive, from one or more sensors, signals indicative of a characteristic of one or more toys present in a play area illuminated by the lighting system and an alteration of the one or more toys; and energize the one or more LEDs of the lighting system to illuminate the play area with light having one or more attributes selected based on the characteristic and alteration of the one or more toys.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

The term "light source" should be understood to refer to any one or more of a variety of radiation sources, including, but not limited to, LED-based sources (including one or more LEDs as defined above).

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The term "toy" as used herein may refer to any physical object that a child may play with, alone or in combination with other toys. Toys may include but are not limited to dolls, action figures, vehicles, remote control vehicles and figures, building blocks (inter connectable and otherwise), toy settings (e.g., buildings, bases, doll houses, castles, dungeons, pretend kitchenettes, toy stages, etc.), wearable toys (e.g., jewelry, armor, costumes, weapons, etc.), and so forth.

To "alter" a toy may refer to performing some action on or with the toy, including but not limited to: moving the toy, e.g., relative to a play area or to another toy or toys; changing a feature of the toy, e.g., position of its limbs, the clothes it wears, etc.; placing the toy into a particular setting, e.g., as the first toy or to join a group of one or more other toys; bringing the toy into physical contact with another toy or object, e.g., attaching connectable building blocks to each other; changing an orientation of the toy relative to the play area and/or to other toys; and so forth.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Many conventional lighting systems and fixtures incorporate light sources such as LEDs than can be selectively energized to emit light having various attributes. However, light output of such systems and fixture is typically controlled using interfaces a wall-mounted interface and/or a smart phone or tablet computer. Some lighting systems automatically control light output based on parameters such as time of day, product placement in a display, or user interest in a displayed product. However, Applicants have recognized and appreciated that it would be beneficial to configure a lighting system to provide light output with one or more attributes selected based on user interaction with one or more physical tangible objects, such as, for example. Toys, in a play area, e.g., to provide ambient, accent, sport or other types of illumination that enhances a child's experience playing with the toys. In view of the foregoing, various embodiments and implementations of the present invention are directed to energizing one or more light sources of a lighting system to emit light having one or more attributes selected based on characteristics of one or more toys being played with and/or alterations of the one or more toys.

Figure 1:
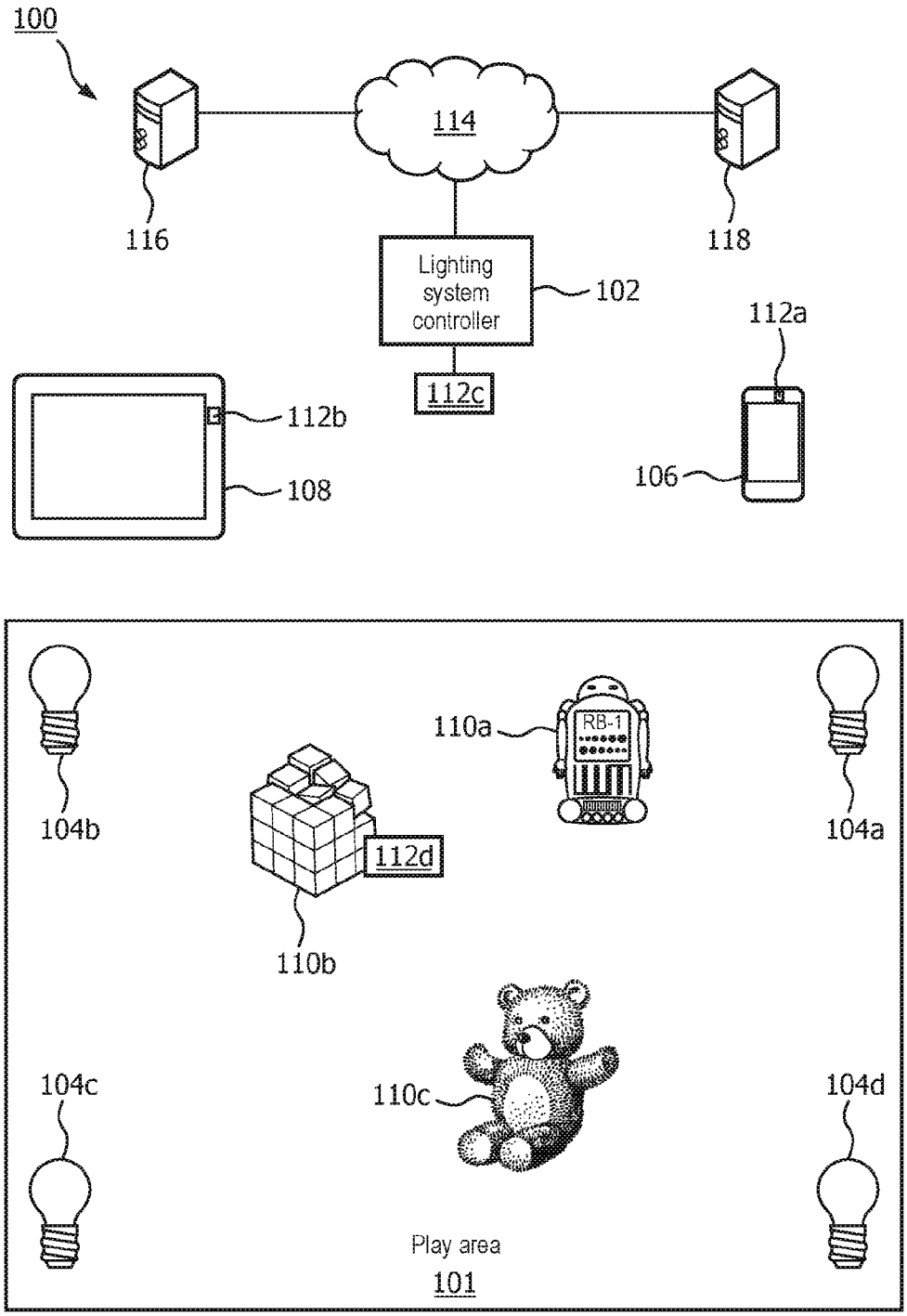
FIG. 1 schematically illustrates an example lighting system configured to illuminate a play area with light having attributes selected based on characteristics of and/or actions taken with toys in the play area, in accordance with various embodiments.

Referring to FIG. 1, in one embodiment, a lighting system 100 may be used to illuminate a play area 101. Play area 101 may be any space illuminated by lighting system 100, such as a room in a house or building, an outdoor space that is illuminated by lighting system 100, a particular space within a large indoor area (e.g., a gym or airport), and so forth. Lighting system 100 may include a lighting system controller 102 that is configured to selectively energize a plurality of light sources, which in FIG. 1 take the form of LEDs 104*a-d*. While depicted as LEDs here, this is not meant to be limiting, and other types of light sources such as incandescent or fluorescent light sources, as well as other numbers and/or configurations of light sources, may be used as well. Also, each LED 104 may actually be a lighting unit or lighting fixture, either which may include a plurality of individual diodes.

In various embodiments, lighting system controller 102 may be a computing device such as a bridge component that is configured to communicate with LEDs 104*a-d* using various wired and/or wireless technologies, including but not limited to Ethernet, WiFi, coded light, ZigBee, Bluetooth, RFID, NFC, and so forth. In various embodiments, lighting system controller 102 may be controlled by an onboard user interface, or it may be controlled by a remote device such as a smart phone 106 or a tablet computer 108. In some embodiments, lighting system controller 102 may be integral with smart phone 106 and/or tablet computer 108, or even with another computing device (not depicted in FIG. 1). A plurality of toys 110*a-c* is also depicted in play area 101.

Various sensors 112 may be in communication with lighting system controller 102 and/or other computing devices (e.g., smart phone 106, tablet computer 108), and may be configured to detect and provide signals indicative of characteristics of and/or alterations to toys 110*a-c*. For instance, referring to FIG. 1, smart phone 106 includes a first sensor 112*a*, tablet computer 118 includes a second sensor 112*b*, a third sensor 112*c* is operably coupled with lighting system controller 102, and a fourth sensor 112*d* is associated with toy 110*b*. Sensors 112 may come in various forms. For instance, sensors 112*a* and 112*b* may be image capture devices (such as cameras) or microphones, both which are common on devices such as smart phones and tablet computers. Other types of sensors may include but are not limited to infrared sensors (including passive infrared), photodiodes, phototransistors, bar code or QR code readers (which may also be cameras), RFID and/or NFC readers, ultrasonic sensors, sonar, Bluetooth transceivers, gyroscopes, accelerometers, proximity sensors, light level sensors (e.g., those typically used to adjust screen brightness), coded light sensors and so forth. Sensors 112, whether standalone, integral with smart phone 106 or tablet computer 108, or associated with a toy 110, may be placed at various positions within or near play area 101, such as on the wall, on the floor, on the ceiling, in a doorway, on a playset on or in which the toys are played with, and so forth.

In various embodiments lighting system controller 102 may be configured to receive, e.g., from sensors 112*a-d*, various signals indicative of various characteristics and/or alterations of toys 110*a-c*. These signals may come in various forms. In some embodiments, such as where the sensor 112 is an image capture device such as a camera (e.g., 112*a* and 112*b*), a signal may come in the form of a signal carrying digital image data captured by the camera. Image processing may be performed on the image data carried in the signal, e.g., by lighting system controller 102 or another computing device such as smart phone 106, tablet computer 108, or another remote computing device (see, e.g., FIG. 3). Image processing may be used to determine information about characteristics and/or alterations of the toys. For instance, image processing may be used to determine a color of a toy, a velocity of a toy relative to its surroundings or another toy, a size or shape of the toy, whether two toys make physical contact, a proximity of two or more toys, whether two or more toys are facing each other, and so forth.

In some embodiments, a toy may be equipped with a visual indicator such as a bar code or QR code. One or more sensors such as sensor 112*a* or 112*b* (e.g., image capture devices that may act as both cameras and barcode/QR code readers) may obtain information about one or more characteristics of one or more toys from the visual indicator. In some embodiments, one or more toys 110 may be equipped with a transmitter (e.g., WiFi, Bluetooth, RFID, NFC, coded light, etc.). In such case, a sensor 112 may obtain information wirelessly from the transmitter associated with the one or more toys.

Signals lighting system controller 102 receives from sensors 112*a-d* may be indicative of various things. For example, lighting system controller 102 may receive a signal indicative of a characteristic of one or more of toys 110*a-c* present in play area 101. Toys such as plurality of toys 110*a-c* may have various characteristics, including but not limited to identity, color(s), size, shape, configuration (e.g., position of movable limbs, clothing worn by toy, weapon carried by toy), proximity to other toys, orientation (relative to play area 101 or other toys), various levels of genus and species (e.g., animal→mammal→ape→gorilla), and so forth.

Additionally or alternatively, lighting system controller 102 may receive a signal indicative of an alteration of the one or more toys. For example, assume first and second toy 110*a* and 110*b* have NFC transceivers that are configured to detect one another when those toys are brought within a predetermined proximity of each other (e.g., within NFC range). On such detection, one or both toys may emit a signal indicative of the toys' proximity or a change thereof. That signal may be received by one or more sensors 112 and communicated to lighting system controller 102, or lighting system controller 102 itself may receive the signal directly. As another example, lighting system controller 102 may receive a signal indicative of an addition of one or more toys 110 to play area 101. For instance, a camera (e.g., 112*a* or 112*b*) of a portable computing device may detect visually when third toy 110*c* is introduced to play area 101. As another example, the signal may be indicative of a change in orientation of the one or more toys, alone or relative to another toy. For instance, sensor 112 such as first sensor 112*a* may detect that a first toy representing a female is turned by a child to face a second toy representing a male (suggesting romance).

In various embodiments, a signal indicative of an alteration of the one or more toys may include a signal indicative of physical contact between two or more toys. For instance, instead of a robot and toy cube, assume that first and second toys 110*a* and 110*b* are two toy blocks. When one or more sensors 112 (e.g., 112*d*) detects that those two blocks make physical contact with each other, the one or more sensors may transmit a signal to lighting system controller 102. In addition to physical contact, in embodiments where toys include interlocking building blocks, signals indicative of two or more interlocking blocks being secured together or connected could be provided to lighting system controller 102, e.g., by one or more sensors 112. In some embodiments, a special block that is configured to communicate with lighting system controller 102 (e.g., via Bluetooth, WiFi, NFC, coded light, etc.) may be added to a construction to cause a particular lighting scene to be created by lighting system 100. For instance, when building a castle with a special castle-themed block, altering a catapult connected block may cause lighting system 100 to initiate a dynamic, battle-themed lighting scene (e.g., "castle siege"). Moving altering the catapult in a different way (e.g., moving it away from a wall) may cause lighting system 100 to initiate a "peaceful" lighting scene.

Physical contact between toys other than blocks, such as physical contact between vehicles or action figures, may also be detected, e.g., by one or more sensors 112. Or, for younger children, appropriate placement of shaped blocks into similarly-shaped recesses may be detected, e.g., by one or more sensors 112.

Physical contact between toys may be detected by one or more sensors 112 in various ways. In some embodiments, physical contact between toys may be detected by sensors on the toys themselves (e.g., 112*d*). For instance, a capacitive sensor on one or more building blocks may detect changes in capacitance of that block occurring in response to physical contact with other blocks. Additionally or alternatively, toys may be equipped with NFC components that may be activated when the toys are in physical contact. In various embodiments, sensors 112 on the toys may provide a signal indicative of physical contact and/or interconnection between toys to lighting system controller 102, either directly (e.g., via RFID, Bluetooth, NFC if they're close enough, coded light, etc.) or indirectly, e.g., via transmitters on other toys. In other embodiments, sensors 112 separate from toys may detect physical contact between toys. For example, image capture devices such as 112*a* or 112*b* may visually detect physical contact between toys. In some cases, one or more sensors 112 in the form of a pressure wave sensor (e.g., microphone) may listen for a noise that results from physical contact between two or more toys, such as an alarm or other noise raised by one or both toys (e.g., when a toddler places the correct block in the correct hole).

In response to signals such as those described above, lighting system controller 102 may be configured to energize one or more LEDs 104*a-d* of lighting system 100 to provide play area 101 with light having one or more attributes selected based on a characteristic of one or more toys 110*a-c* and/or an alteration of one or more toys 110*a-c*. Attributes of light (ambient or otherwise) that may be selected include but are not limited to hue, temperature, saturation, brightness, intensity, dynamic lighting effects and sequences, and so forth.

For instance, if lighting system controller 102 determines, e.g., based on one or more signals from sensors 112, that a toy introduced into play area 101 is associated with an evil character, lighting system controller 102 may cause one or more LEDs 106 to emit light with various dynamic lighting effects, such as to emulate flashing lightning or to emit a dark color. As another non-limiting example, if lighting system controller 102 determines, e.g., based on one or more signals from sensors 112, that two or more toys in play area 101 are based on aquatic life forms (fictional or nonfictional), lighting system controller 102 may cause one or more LEDs 104 to emit light having one or more attributes associated with aquatic life, such as a blue color. As another example, if lighting system controller 102 determines, e.g., based on one or more signals from sensors 112, that a projectile toy such as a grenade or missile is has been launched, or that a toy configured to mimic being destroyed has in fact been manipulated by a child to mimic such destruction, lighting system controller 102 may cause one or more LEDs 104 to emit a dynamic lighting sequence (e.g., flashing light) to emulate an explosion. As yet another non-limiting example, if lighting system controller 102 determines, e.g., based on one or more signals from sensors 112, that male and female toys are oriented towards each other, lighting system controller 102 may cause one or more LEDs 104 to emit romantic light. As yet another non-limiting example, if lighting system controller 102 determines, e.g., based on one or more signals from sensors 112, that a toddler has correctly placed a toy having a particular shape into a hole having the same shape, lighting system controller 102 may cause one or more LEDs 104 to emit light with congratulatory attributes (e.g., excited blinking, flashing, encouraging color, etc.)

As mentioned previously, in various embodiments, the signal indicative of an alteration of the one or more toys may include a signal indicative of an addition of an additional toy to the play area. In some such embodiments, the signal is indicative of a characteristic shared between a newly added toy and toys already in play area 101. For instance, if the shared characteristic of the first and second toys is that both are orange, lighting system controller 102 may energize one or more LEDs to emit light having a complimentary color to orange, or even orange light. As another example, the characteristic shared between the first and second toys may be an environment inhabited by fictional or nonfictional organisms or characters on which the first and second toys are based, such as in a jungle. In such case, lighting system controller 102 may energize one or more LEDs 104 to emit light having attributes associated with a jungle, such as green.

As noted above, in various embodiments, lighting system controller 102 may receive a signal indicative of an identity associated with the toy. In some embodiments, the signal may contain sufficient information for lighting system controller 102 to identify the toy without further action. For example, if the toy has an RFID transceiver or QR code, a sensor 112 may be able to obtain sufficient data from the toy to identify it (e.g., model or serial number, the name of a character on which the toy is based, etc.). In other embodiments, however, the signal may only contain a clue about the toy's identity. In such embodiments, lighting system controller 102 may be configured to take additional action, such as corresponding with a remote computing system over one or more networks 114 (e.g., the Internet), to determine the toy's identity based on the received clue.

Once lighting system controller 102 has the toy's identity, in various embodiments, lighting system controller 102 may correspond with a remote computing system, e.g., over one or more networks 114, to determine an additional characteristic of the one or more toys based on the identity of the toy. In various embodiments, lighting system controller 102 may then energize one or more LEDs 104 to emit ambient light having one or more attributes selected based on the additional characteristic of the one or more toys.

For instance, once the toy is identified, lighting system controller 102 may determine a color associated with the toy's identity. To determine the color, in some embodiments, lighting system controller 102 may facilitate an image search by a search engine 116. In some such embodiments, lighting system controller 102 may select a color of light to be emitted by one or more LEDs 104 based on results of the image search. In other such embodiments, lighting system controller 102 may consult a remote database server 118, e.g., provided by the toy's manufacturer or compiled by enthusiasts, that stores predefined light attributes to be selected by lighting systems for use when particular toys or combinations of toys are in play. For instance, a toy manufacturer may host on remote database server 118 a portal with a predetermined light scene that should be utilized when two or more of its toys are in play. As another example, the portal may have a predetermined light scene that should be utilized when a particular combination of toys are in play.

In various embodiments, lighting system controller 102 may be unable to identify the toy. In such case, lighting system controller 102 may energize one or more LEDs 104 to emit light having attributes selected based on other criteria. For example, lighting system controller 102 may receive a signal from one or more sensors 112 indicative of a color of the unidentifiable toy. Lighting system controller 102 may energize one or more LEDs 104 to emit light of a similar color, or of a complimentary color. If two or more toys are present in play area 101, and the toys have different colors, then lighting system controller 102 may energize one or more LEDs 104 to emit a mixture of those toys' colors, or may energize one LED to emit one color and another LED to emit another color. In some embodiments, if the particular identity of a toy is unattainable but a broader genus, or type, of the toy is attainable, lighting system controller 102 may facilitate an image search using that genus or type as a query, and may select a light color based on the results.

In addition to the examples described previously, in various embodiments, lighting system controller 102 may select one or more attributes of light to be emitted by one or more LEDs 104 based on signals from one or more sensors 112 indicative of actions taken by a user while wearing one or more wearable toys. For instance, one or more sensors 112 may detect that multiple children are wearing costumes associated with fictional or nonfictional characters that inhabit a particular habitat. Based on signals from these sensors, lighting system controller 102 may take various actions, such as energizing one or more LEDs 104 to emit light having one or more attributes associated with that habitat.

As another example, one or more sensors 112 may detect that a child wearing a particular wearable toy is moving quickly and/or in rhythm (e.g., dancing). Based on signals from these sensors, lighting system controller 102 may take various actions, such as energizing one or more LEDs 104 to emit light having one or more attributes associated with the child's activity (e.g., mimic dance floor lighting). In some embodiments, lighting system controller 102 may energize one or more LEDs 104 in synch with the child's movement, to enhance the child's experience while wearing the wearable toy.

As another example, one or more sensors 112 may detect that a child wearing a particular wearable toy in the form of a puppet on her hand. One or more sensors 112 may also detect that the child is playing with the puppet on a toy stage. Based on signals from these sensors, lighting system controller 102 may take various actions, such as energizing one or more LEDs 104 to emit light having one or more attributes associated with a performance being enacted by the child with the puppet.

In various embodiments, in addition to acting as sensors (or in some cases as lighting system controller 102), smart phone 106 and/or tablet computer 108 may be integrated with child's play. For instance, in some embodiments, smart phone 106 and/or tablet computer 108 may render, e.g., on a touch screen display, images that are related to the child's activity. For instance, a prop for a play being performed by the child with one or more puppets may be displayed. Additionally or alternatively, in various embodiments, smart phone 106 and/or tablet computer 108 may, e.g., based on signals from one or more sensors, provide audio to enhance a child's playing experience. For instance, smart phone 106 and/or tablet computer 108 may emit the sound of thunder to accompany "lighting" produced by lighting system 100.

In various embodiments, lighting system controller 102 may be configured to select one or more attributes of the light emitted by one or more LEDs 104 based on information other than signals from sensors 112. For instance, in some embodiments, lighting system controller 102 may select one or more light attributes based a number of lighting units configured to illuminate play area 101, types of and/or light-rendering capabilities of lighting units (e.g., incandescent, retrofit LED, LED strip, fluorescent bulb, etc.) utilized to illuminate play area 101, and/or a spatial arrangement of lighting units configured to illuminate play area 101. In other embodiments, lighting system controller 102 may first select the one or more light attributes based solely on signals received from sensors 112, and may then alter the selected attributes based on the number of LEDs 104 present.

Figure 2:
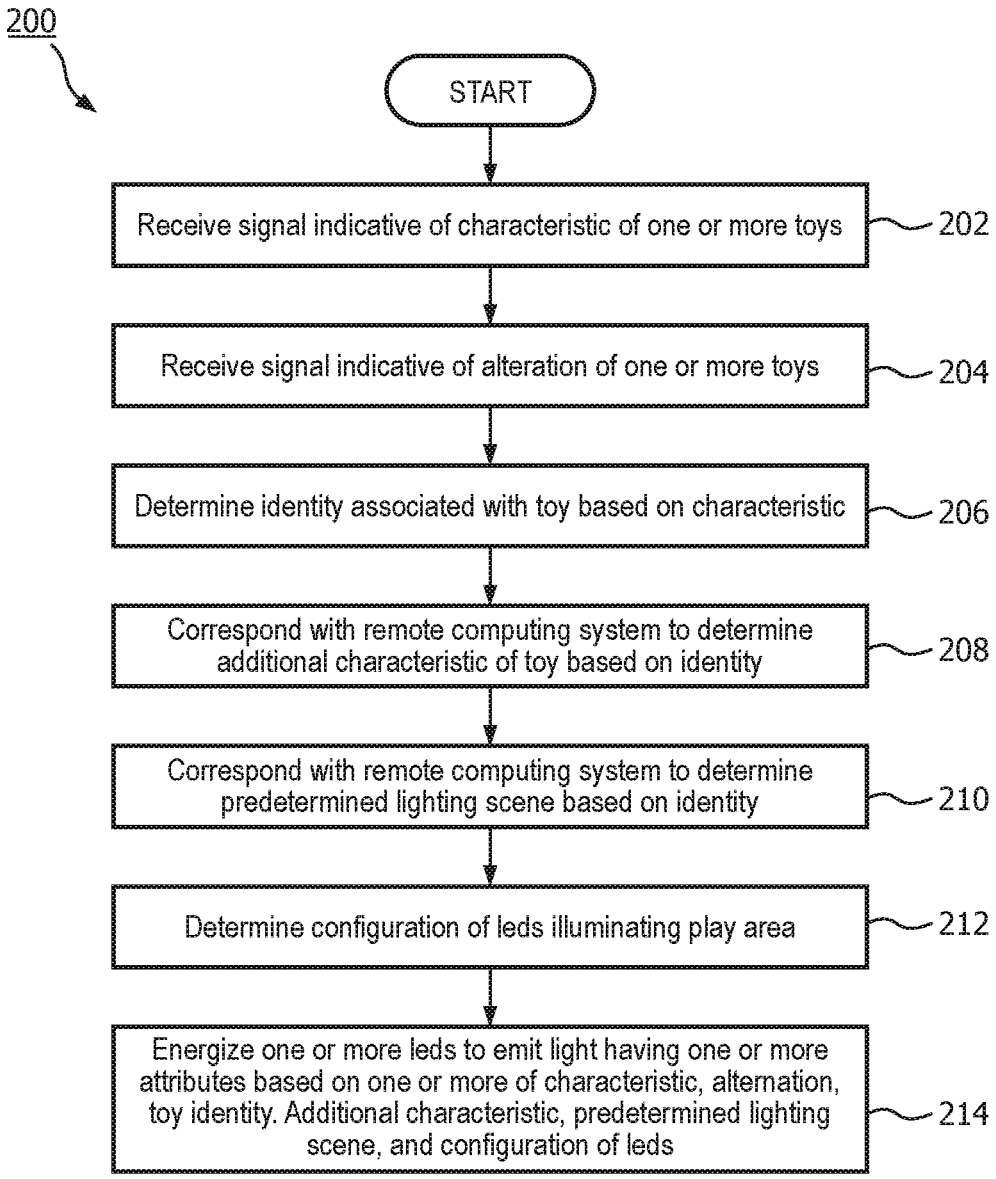
FIG. 2 depicts an example method for selecting one or more attributes of light output based on characteristics of and/or actions taken with one or more toys in a play area, in accordance with various embodiments.

FIG. 2 depicts an example method 200 that may be implemented by lighting system controller 102, in accordance with various embodiments. Although the operations are depicted in a particular order, this is not meant to be limiting. In various embodiments, one or more of these operations may be reordered and/or omitted, and other operations may also be performed.

At block 202, a signal indicative of a characteristic of one or more toys may be received, e.g., from an image capture device or wireless receiver. For instance, a camera may capture a shape, color, size or other characteristic of a toy, and provide that information to lighting system controller 102. In embodiments where the toy provides identifying information using some sort of identifier transmitter or visual marking (e.g., RFID tag, NFC tag, QR code, bar code, etc.), another type of sensor 112, such as an RFID or NFC transceiver, or a QR or bar code reader, may capture the identifying information and provide it to lighting system controller 102.

At block 204, a signal indicative of an alteration of one or more toys may be received, e.g., by lighting system controller 102. For example, one or more sensors 112 may detect, e.g., visually using image capture technology (e.g., camera) or otherwise (e.g., by monitoring a beacon on the toy), that a single toy is reoriented or otherwise manipulated. Or, if there are multiple toys present in play area 101, one or more sensors 112 may detect, e.g., visually or otherwise, that two or more toys are repositioned relative to one another, brought into physical contact or even interconnected with each other.

At block 206, an identity associated with the toy may be determined, e.g., by lighting system controller 102, based on the characteristic of the toy received in the signal at block 202. An identity associated with a toy may include an identifier having any combination of computer readable numbers, characters or symbols. In various embodiments, the identity associated with a particular toy may not be unique to that toy, but rather may be the identity of a fictional or nonfictional character on which that toy is based. Thus, there may be multiple copies of the same toys that have the same identifier. In some instances, multiple versions of toys may be based on a single fictional or nonfictional character. For instance, one toy may include clothing appropriate for the jungle, whereas another toy based on the same character may include clothing appropriate for the tundra. In such a scenario, lighting system controller 102 may ultimately select one or more attributes of ambient lighting based on both the identity associated with the toy and the outfit the toy is wearing. Playing with the jungle toy version of the character may cause jungle-themed ambient lighting to be emitted by lighting system 100. Playing with the tundra toy version of the character may cause tundra-themed ambient lighting to be emitted by lighting system 100.

At block 208, lighting system controller 102 may correspond with a remote computing system to determine an additional characteristic of the toy. In some instances, lighting system controller 102 may initially receive a signal from one or more sensors 112 that is indicative of a characteristic of the toy that is insufficient to identify the toy. However, that characteristic may at least offer a clue of the toy's identity. In such case, lighting system controller 102 may correspond with a remote computing system hosted by, e.g., a toy manufacturer, to inquiry about an identity of a toy that has the particular characteristic. Thus, for instance, if a toy having a particular color or brightness is detected, lighting system controller 102 may correspond with a toy manufacturer's computing system to determine that a particular toy is the only toy having that color or brightness.

In other instances, lighting system controller 102 may correspond with a remote computing system hosting a search engine to perform an image search. Based on results from the image search, lighting system controller 102 may select one or more colors to be emitted by one or more LEDs 104. For instance, assume lighting system controller 102 ascertains an identity associated with a toy based on a signal received from one or more sensors 112. That identity may be used as a query in the image search. Lighting system 102 may select one or more colors from the resulting images, such as a predominant color or colors, or even a plurality of the most common (e.g., ranked) colors, to be emitted by one or more LEDs 104. For instance, if blue is the most common color found in images returned from the image search, and orange is the second most common color, then lighting system 100 may emit predominantly blue light with an orange accent.

At block 210, which may be performed in addition to or instead of block 208, lighting system controller 102 may correspond with a remote computing system, such as one hosted by or associated with a toy manufacturer, to determine a predefined lighting scene or sequence associated with a detect toy characteristic and/or alteration. For example, the toy manufacturer computing system or another remote computing system may provide a predefined lighting scheme that is to be emitted by lighting systems when a particular toy they manufacture is in play.

At block 212, lighting system controller 102 may determine a configuration (e.g., count of light sources, physical characteristics and/or capabilities of light sources, spatial arrangement of light sources, etc.) of one or more light sources under its control. For instance, lighting system controller 102 in FIG. 1 may determine that it controls four light sources, LEDs 104*a-d*. In some embodiments, lighting system controller 102 may further determine whether all four light sources are operational. If one is out, lighting system controller 102 may modify its determination to three light sources available.

In various embodiments, lighting system controller 102 may determine the configuration of one more light sources under its control before and/or after it selects one or more light attributes to emit through those light sources. In some instances, the configuration of the one or more light sources may affect which light attributes lighting system controller 102 selects. In other instances, the light attributes selected by lighting system controller 102 may be independent of the configuration of light sources under its control. In such case, lighting system controller may selectively energize one or more LEDs 104 to emit light having the selected attributes based in part on the configuration of the one or more light LEDs 104.

While all the light sources shown in FIG. 1 are LEDs, this is not meant to be limiting. In some cases, lighting system controller 102 may be in control of other types of light sources, such as incandescent and/or fluorescent, in addition to LEDs 104. Those other types of light sources may, in many cases, be less adjustable than LEDs. Accordingly, lighting system controller 102 may take into account the less- or non-adjustable nature of these other types of light sources when it determines the configuration of light sources under its control at block 212 selectively energizes one or more of those light sources at block 214. For example, if a selected ambient light attribute is a dark color (e.g., to mimic nighttime or underwater), lighting system controller 102 may dim any dimmable incandescent lights under its control to minimize their impact on the overall ambient light.

At block 214, lighting system controller 102 may energize one or more LEDs 104, or may facilitate energizing of one or more LEDs 104, based on various signals. These signals may include but are not limited to one or more of the characteristic of one or more toys received at block 202, the alteration of one or more toys received at block 204, a toy identity determined at block 206, another toy characteristic obtained from a remote computing system at block 208, a predetermined lighting scene obtained at block 210, and/or a configuration of one or more light sources under the control of lighting system controller 102 determined at block 212.

Figure 3:
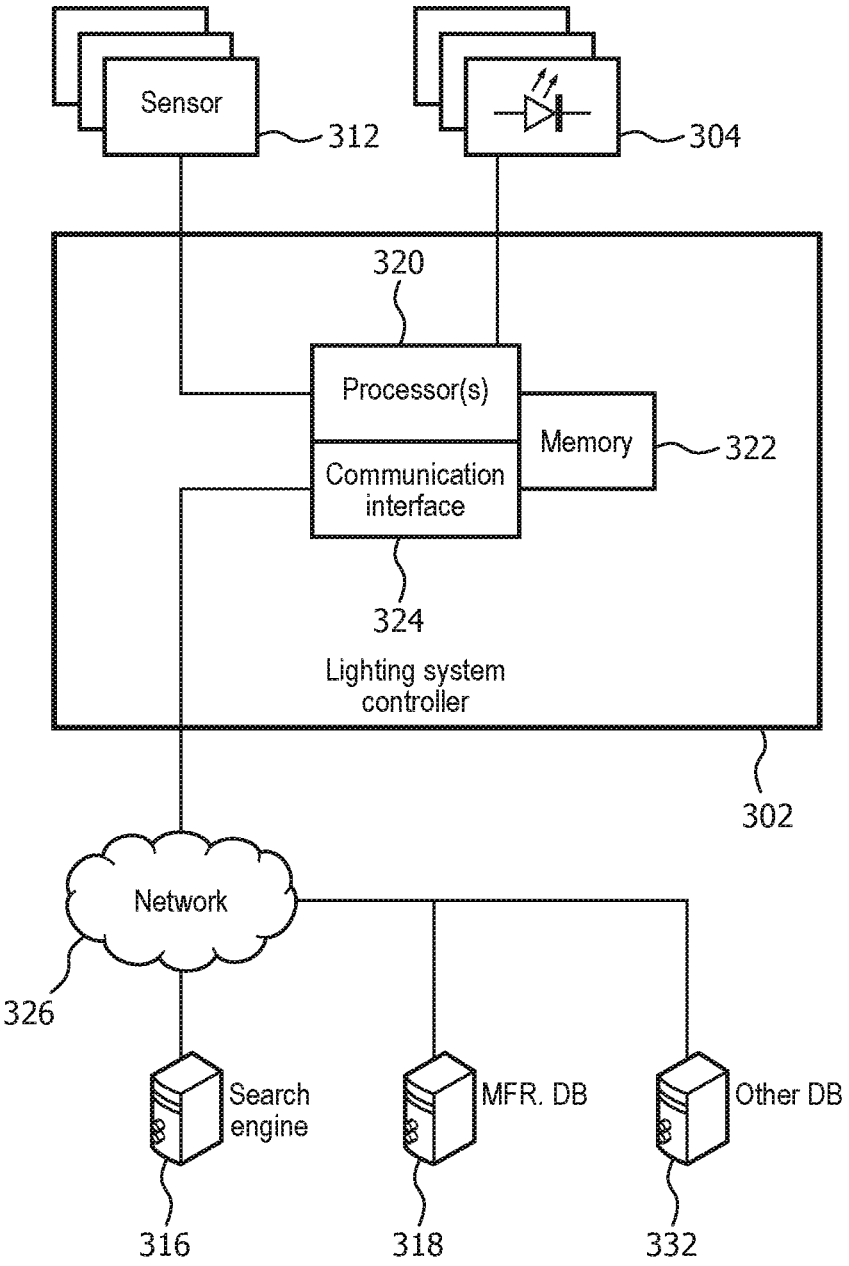
FIG. 3 depicts example components that may interact to facilitate a lighting system emitting light with attributes selected based on a characteristic and/or alteration of one or more toys in a play area, in accordance with various embodiments.

FIG. 3 schematically depicts various components that may interact with a lighting system controller 302, which may be similar to lighting system controller 102 of FIG. 1, in accordance with various embodiments. Lighting system controller 302 may include one or more processors 320 that may be operably coupled with memory 322 and/or a communication interface 324. One or more processors 320 may also be operably coupled with one or more sensors 312, and one or more LEDs 304 (or other light sources) under the control of lighting system controller 302, e.g., via communication interface 324.

In various embodiments, one or more processors 320 may include one or more microprocessors configured to execute instructions stored, e.g., in memory 322, to perform selected aspects of method 200. In various embodiments, communication interface 324 may implement various technologies to communicate with other computing devices and/or lighting units, e.g., over one or more computer networks 326. Communication technologies that may be implemented by communication interface 324 include but are not limited to WiFi, Ethernet, Bluetooth, RFID, NFC, ZigBee, coded light, and so forth.

As described above, lighting system controller 302 may correspond, e.g., via communication interface 324, with various remote computing systems to determine one or more attributes of ambient light attributes to be emitted. In some embodiments, and as described above, lighting system controller 302 may correspond with a search engine 316, e.g., to obtain one or more colors from one or more image search results. In some embodiments, and as described previously, lighting system controller 302 may correspond with a manufacturer's database 318, e.g., to obtain one or more predefined ambient light attributes and/or a predefined lighting scene to be implemented when particular toys of that manufacturer are in play. In some embodiments, lighting system controller 302 may correspond with other databases 332, such as databases established by enthusiasts that store custom lighting scenes, e.g., to obtain one or more ambient light attributes to be implemented when, for instance, toys from different manufacturers are in play simultaneously.

While remote computing systems such as search engines (116, 316), manufacturer's databases (118, 318) and so forth are shown as being remotely located from lighting system controller 302, this is not meant to be limiting. In some embodiments, lighting system controller 302 may include, e.g., in memory 322, a database of toy identities and associated light attributes. In various embodiments, the information in this database may be obtained from manufacturers, e.g., over the Internet. In various embodiments, the database may be populated manually by a user, such as a child's parent or the child him or herself, e.g., using smart phone 106 or tablet computer 108. In some embodiments, a toy may come with preprogrammed light attribute data which may be automatically (e.g., when brought into NFC range) or manually provided to lighting system controller 302, e.g., via communication interface 324.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims between parentheses, if any, are provided merely for convenience and should not be construed as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A method for controlling a lighting system having one or more LEDs, comprising:

receiving, at a lighting system controller, a signal indicative of a first characteristic of one or more toys present in a play area supplied with ambient light by the lighting system;

receiving, at the lighting system controller, a signal indicative of an alteration of the one or more toys;

corresponding, by the lighting system controller, with a remote computing system to determine an additional characteristic of the one or more toys based on the first characteristic, said additional characteristic including color associated with the one or more toys; and energizing, by the lighting system controller, the one or more LEDs of the lighting system to illuminate the play area with light having one or more attributes selected based on the first characteristic of the one or more toys, the additional characteristic of the one or more toys and the alteration of the one or more toys.

2. The method of claim 1, further comprising determining, by the lighting system controller based on the first characteristic of the one or more toys, an identity associated with the toy.

3. The method of claim 2, wherein the determination of the additional characteristic is based on the identity of the toy.

4. The method of claim 1, further comprising:

facilitating, by the lighting system controller, an image search via the remote computing system by a search engine associated with the remote computing system by submitting, to the search engine, a search query comprising search criteria that is based on the first characteristic; and selecting, by the lighting system controller, the color based on results of the image search.

5. The method of claim 1, wherein the signal indicative of the alteration of the one or more toys comprises a signal indicative of at least one of a change in proximity or physical contact between two or more toys.

6. The method of claim 1, wherein the signal indicative of an alteration of the one or more toys comprises a signal indicative of a change in orientation of the one or more toys.

7. The method of claim 1, wherein the one or more toys comprises a first toy, and the signal indicative of the alteration of the one or more toys comprises a signal indicative of an addition of a second toy to the play area.

8. The method of claim 1, wherein the signal indicative of the first characteristic of one or more toys present in the play area comprises a signal from an image capture device.

9. The method of claim 1, wherein the signal indicative of the first characteristic of one or more toys present in the play area comprises a wireless signal from a transmitter associated with the one or more toys.

10. The method of claim 1, wherein the one or more attributes are selected further based on a number of lighting units configured to illuminate the play area.

11. The method of claim 1, wherein the one or more attributes are selected further based on a spatial arrangement of lighting units configured to illuminate the play area.

12. The method of claim 1, wherein the one or more attributes are selected further based on light-rendering capabilities of lighting units configured to illuminate the play area.

13. A lighting system, comprising:

one or more LEDs;

one or more sensors to detect a first characteristic of one or more toys present in a play area illuminated by the lighting system and an alteration of the one or more toys; and a lighting system controller operably coupled with the one or more LEDs and configured to:

receive, from the one or more sensors, signals indicative of the first characteristic of one or more toys present in a play area and the alteration of the one or more toys;

correspond with a remote computing system to determine an additional characteristic of the one or more toys based on the first characteristic, said additional characteristic including a color associated with the one or more toys; and energize the one or more LEDs of the lighting system to illuminate the play area with light having one or more attributes selected based on the first characteristic, the additional characteristic and the alteration of the one or more toys.

14. The lighting system of claim 13, wherein the lighting system controller is further configured to identify, based on the first characteristic of the one or more toys, an identity associated with the toy.

15. The lighting system of claim 14, wherein the lighting system controller is further configured to correspond with the remote computing system to determine the additional characteristic of the one or more toys based on the identity of the toy.

16. The lighting system of claim 15, wherein the additional characteristic comprises a brightness associated with the one or more toys.

17. The lighting system of claim 13, wherein the lighting system controller is further configured to facilitate an image search via the remote computing system by a search engine associated with the remote computing system by submitting, to the search engine, a search query comprising search criteria that is based on the first characteristic, and wherein the lighting system controller is further configured to select the color based on results of the image search.

18. An apparatus for controlling a lighting system with one or more LEDs, comprising:

one or more processors; and memory operably coupled with the one or more processors and containing instructions that, by execution of the instructions by the one or more processors, cause the one or more processors to:

receive, from one or more sensors, signals indicative of a first characteristic of one or more toys present in a play area illuminated by the lighting system and an alteration of the one or more toys;

correspond with a remote computing system to determine an additional characteristic of the one or more toys based on the first characteristic, said additional characteristic including a color associated with the one or more toys; and energize the one or more LEDs of the lighting system to illuminate the play area with light having one or more attributes selected based on the first characteristic, the additional characteristic and the alteration of the one or more toys.

19. The apparatus of claim 18, wherein the signal indicative of the alteration of the one or more toys comprises a signal indicative of at least one of a change in proximity or physical contact between two or more toys.

20. The apparatus of claim 18, wherein the instructions, by the execution of the instructions by the one or more processors, cause the one or more processors to:

facilitate an image search via the remote computing system by a search engine associated with the remote computing system by submitting, to the search engine, a search query comprising search criteria that is based on the first characteristic, and select the color based on results of the image search.

* * * * *